US008157346B2

(12) United States Patent
Nakamura

(10) Patent No.: US 8,157,346 B2
(45) Date of Patent: Apr. 17, 2012

(54) INK SUPPLY DEVICES

(75) Inventor: Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 281 days.

(21) Appl. No.: 12/729,233

(22) Filed: Mar. 22, 2010

(65) Prior Publication Data

US 2010/0245458 A1 Sep. 30, 2010

(30) Foreign Application Priority Data

Mar. 27, 2009 (JP) ..... 2009-080593

(51) Int. Cl.
*B41J 29/393* (2006.01)
*B41J 2/175* (2006.01)

(52) U.S. Cl. ..... 347/19; 347/86

(58) Field of Classification Search ..... 347/19, 347/86

See application file for complete search history.

(56) References Cited

U.S. PATENT DOCUMENTS

| | | | | |
|---|---|---|---|---|
| 6,739,689 | B2 * | 5/2004 | Choi | 347/19 |
| 8,002,380 | B2 * | 8/2011 | Kondo | 347/19 |
| 2004/0179056 | A1 * | 9/2004 | Katayama | 347/19 |
| 2007/0048058 | A1 | 3/2007 | Koga et al. | |
| 2008/0180498 | A1 | 7/2008 | Hattori et al. | |
| 2009/0039002 | A1 * | 2/2009 | Umeda | 210/100 |
| 2009/0040262 | A1 * | 2/2009 | Watanabe | 347/19 |

FOREIGN PATENT DOCUMENTS

| | | | |
|---|---|---|---|
| JP | 2005-288866 | A | 10/2005 |
| JP | 2007-090761 | A | 4/2007 |
| JP | 2008-246999 | A | 10/2008 |

* cited by examiner

*Primary Examiner* — Geoffrey Mruk
(74) *Attorney, Agent, or Firm* — Baker Botts L.L.P.

(57) ABSTRACT

An ink supply device includes a controller, a cartridge mounting portion, and an ink cartridge. The cartridge mounting portion includes first, second, and third detectors configured to detect first, second, and third detection target portions of the ink cartridge and to output first, second, and third detection information, respectively. The controller is configured to execute a first process based on whether the first detection information and the second detection information are output when the third detection information is output during insertion of the ink cartridge into the cartridge mounting portion. A type of the ink cartridge is determined in the first process.

10 Claims, 10 Drawing Sheets

INK SUPPLY DEVICES

CROSS REFERENCE TO RELATED APPLICATION

This application claims priority to and the benefit of Japanese Patent Application No. 2009-080593, which was filed on Mar. 27, 2009, the disclosure of which is incorporated herein by reference in its entirety.

BACKGROUND OF THE INVENTION

1. Field of the Invention

The present invention relates to an ink supply devices in which a controller is configured to determine a type of an ink cartridge based on a detector detecting a portion of the ink cartridge configured to be mounted to a cartridge mounting portion.

2. Description of Related Art

A known inkjet image recording apparatus, such as an inkjet image recording apparatus described in JP-A-2005-288866, has a recording head having a plurality of nozzles formed therein, and a cartridge mounting portion to which an ink cartridge is mounted. The cartridge mounting portion accommodates the ink cartridge removably. When the ink cartridge is mounted to the cartridge mounting portion, an ink path is formed from the ink cartridge via the cartridge mounting portion to the recording head. Through the ink path, ink is supplied from the ink cartridge to the recording head. The recording head selectively ejects ink supplied from the ink cartridge, as small droplets of ink, from the nozzles. The droplets of ink are ejected onto a recording medium, such that an image is recorded thereon.

There are various types of known ink cartridges, each containing ink different in color or volume. In other words, various kinds of known ink cartridges are used with a known image recording apparatus. A known ink cartridge has detection target portions for the recording apparatus to determine the type of ink cartridge. The detection target portions are positioned at positions corresponding to detecting devices, e.g. optical detectors, respectively, which are positioned in the cartridge mounting portion. The detecting devices output signals when detecting the detection target portions, respectively. The image recording apparatus has a controller configured to determine the type of ink cartridge based on the signals output from the detecting devices.

However, the detection target portions may not be correctly detected. For example, a certain degree of clearance may be provided between the ink cartridge and the cartridge mounting portion to facilitate insertion of the ink cartridge into the cartridge mounting portion. With this clearance, the position of the ink cartridge may change in the cartridge mounting portion, e.g., the ink cartridge may tilt relative to the cartridge mounting portion, and the positional relationship between each of the detection target portions and a corresponding one of the detecting devices may vary. In particular, such variations of the positional relationship are likely to occur in an ink cartridge having a plurality of detection target portions, which are spaced a relatively great distance apart, e.g., which are positioned on top and bottom ends of the ink cartridge when the ink cartridge is mounted to the cartridge mounting portion. Because of the variations, the type of the ink cartridge may not be correctly detected, or a position of the ink cartridge in the cartridge mounting portion may not be correctly determined.

SUMMARY OF THE INVENTION

Therefore, a need has arisen for ink supply devices which overcome these and other shortcomings of the related art. A technical advantage of the present invention is that detection target portions of an ink cartridge can be accurately detected by detectors in a cartridge mounting portion.

According to an embodiment of the present invention, an ink supply device comprises a controller, a cartridge mounting portion, and an ink cartridge configured to be mounted to the cartridge mounting portion by being inserted thereinto in an insertion direction. The ink cartridge comprises a first detection target portion positioned at an upper front side of the ink cartridge during an insertion of the ink cartridge into the cartridge mounting portion in the insertion direction, a second detection target portion positioned at a lower front side of the ink cartridge during the insertion of the ink cartridge into the cartridge mounting portion in the insertion direction, and a third detection target portion positioned at a front side of the ink cartridge during the insertion of the ink cartridge into the cartridge mounting portion in the insertion direction, wherein the third detection target portion is positioned between the first detection target portion and the second detection target portion. The cartridge mounting portion comprises a first detector configured to detect the first detection target portion and to output first detection information when the first detector detects the first detection target portion, a second detector configured to detect the second detection target portion and to output second detection information when the second detector detects the second detection target portion, and a third detector configured to detect the third detection target portion and to output third detection information when the third detector detects the third detection target portion. The controller is configured to execute a first process based on whether the first detection information and the second detection information are output when the third detection information is output during the insertion of the ink cartridge into the cartridge mounting portion, and a type of the ink cartridge is determined in the first process.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-10, like numerals being used for like corresponding parts in the various drawings.

Figure 1:
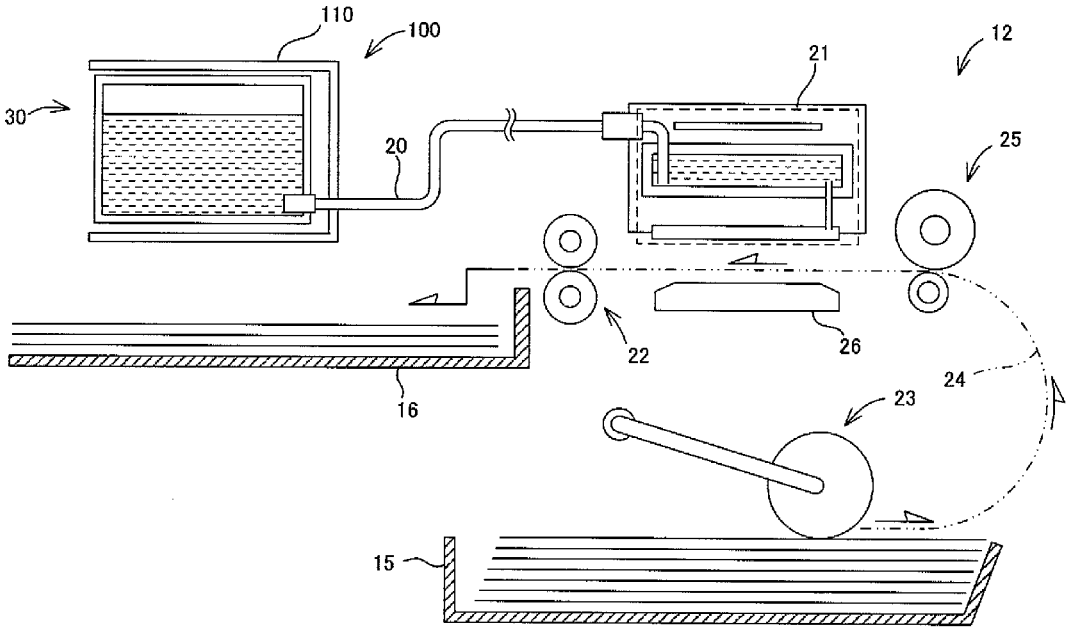
FIG. 1 is a schematic cross-sectional view of an internal structure of a printer according to an embodiment of the present invention.

Referring to FIG. 1, a printer 12 is a color inkjet printer configured to record an image on a recording medium, e.g., a sheet of paper (hereinafter referred to as a recording sheet), by selectively ejecting ink of each color as ink droplets from a recording head 21. Ink is supplied to the recording head 21 from an ink cartridge 30. In this embodiment, the ink cartridge 30 stores ink of cyan (C), magenta (M), yellow (Y), or black (K). In other words, the printer 12 uses four ink cartridges 30 storing ink of different colors respectively.

The ink cartridge 30 and the recording head 21 are coupled with each other via an ink tube 20. There are four ink tubes 20 in accordance with four ink colors. Ink of each color stored in each ink cartridge 30 is supplied to recording head via a corresponding ink tube 20.

The printer 12 comprises a sheet supply tray 15 that holds a stack of recording sheets. Each recording sheet is picked up by a pick up roller 23 and conveyed to a sheet conveying path 24. In the sheet feed path 24, a pair of conveying rollers 25 conveys the recording sheet onto a platen 26. The recording head 21 selectively ejects ink droplets of each color onto the recording sheet passing over the platen 26, such that an image is recorded on the recording sheet. A pair of ejection rollers 22 ejects the recording medium passing over the platen 26 to an output tray 16.

The printer 12 comprises an ink supply device 100 comprising the four ink cartridges 30 storing ink of the above-described colors and a cartridge holder 110. The four types of ink cartridge 30 are identical in structure except for structures of ribs 77, 80, more specifically except for the presence or absence of cut-outs 78, 81 in the ribs 77, 80. Thus, the following description will be made based on one type of ink cartridge 30.

Figure 2A:
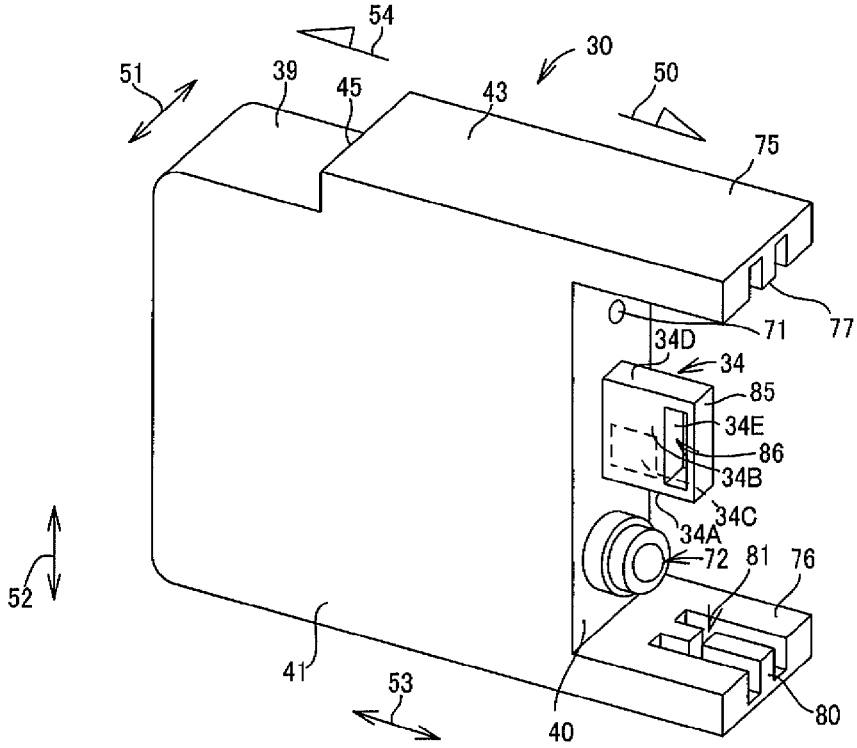
FIG. 2A is a perspective view of an ink cartridge according to an embodiment of the present invention.
Figure 2B:
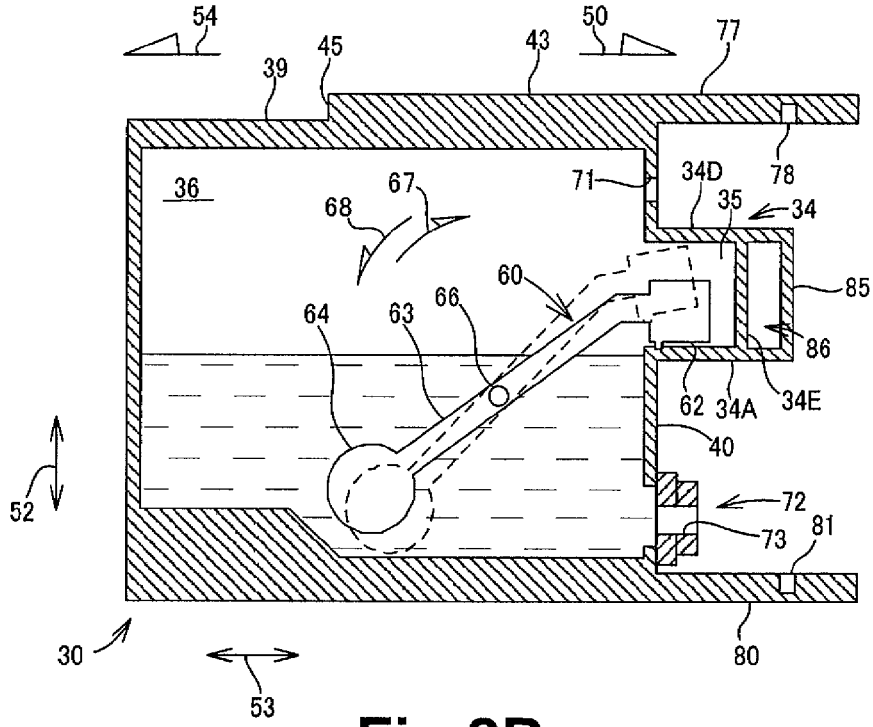
FIG. 2B is a vertical cross-sectional view of the ink cartridge.

Referring to FIGS. 2A and 2B, the ink cartridge 30 has substantially a rectangular parallelepiped shape or box shape. A width of ink cartridge 30 in a width direction as indicated by an arrow 51 is relatively short, and each of a height of ink cartridge 30 in a height direction as indicated by an arrow 52 and a depth of ink cartridge 30 in a depth direction as indicated by an arrow 53 is greater than the width of ink cartridge 30. The ink cartridge 30 is inserted into the cartridge holder 110 in a direction as indicated by an arrow 50 (hereinafter referred to as an insertion direction 50), being in the position (posture) shown in FIG. 2A. The insertion direction 50 is parallel to the depth direction 53. The ink cartridge 30 comprises a front surface 40, as an example of a reference surface, facing forward with respect to the insertion direction 50. The ink cartridge 30 comprises an air communication opening 71, an ink amount detection portion 34 and an ink supply portion 72 at the front surface 40.

The ink cartridge 30 comprises an ink chamber 36 formed therein. The ink chambers 36 of the four ink cartridges 30 store cyan ink, magenta ink, yellow ink, and black ink, respectively.

The ink cartridge 30 is made of a translucent material, e.g., a transparent or semi-transparent material, so that light, e.g., visible or infrared light can pass through the ink cartridge 30. A first protruding member 75 and a second protruding member 76 protrude from the front surface 40 in the insertion direction 50.

Figure 3:
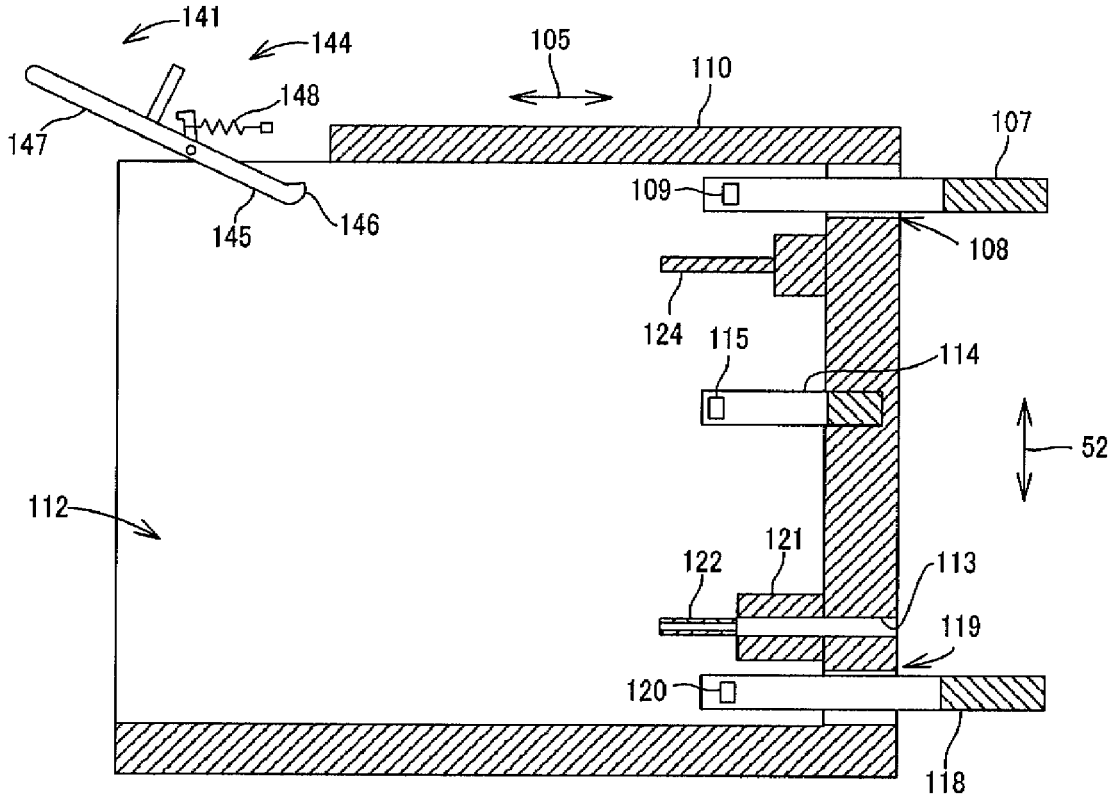
FIG. 3 is a vertical cross-sectional view of a cartridge holder.

The ink cartridge 30 comprises the ink amount detection portion 34. Through the ink amount detection portion 34, the amount of ink stored in the ink chamber 36 is visually or optically detected. The ink amount detection portion 34 has a substantially rectangular parallelepiped shape that is thin in the width direction 51. The ink amount detection portion 34 is integrally formed with the front surface 40 of the ink cartridge 30. The ink amount detection portion 34 protrudes outward (rightward in FIG. 2B) from a middle portion of the front surface 40 with respect to the height direction 52. The ink amount detection portion 34 is smaller in width than the front surface 40 in the width direction 51. A width of the ink amount detection portion 34 is set, such that the ink amount detection portion 34 can enter a detection area 115 of an optical detector 114 (FIG. 3). The ink amount detection portion 34 is formed of a translucent material through which light can pass in the width direction 51.

Referring to FIG. 2B, the ink amount detection portion 34 has an inner space 35 formed therein. The inner space 35 communicates with the ink chamber 36. The inner space 35 of the ink amount detection portion 34 is defined by walls of the ink amount detection portion 34, i.e., a bottom wall 34A, sidewalls 34B, a top wall 34D, and a front wall 34E. A light blocking plate 62 of a detection arm 60 is positioned in the inner space 35. The optical detector 114 emits light, e.g., visible or infrared light toward an irradiated portion 34C positioned at a lower portion of the sidewalls 34B of the ink amount detection portion 34.

The detection arm 60 is positioned in the ink chamber 36. The detection arm 60 comprises the light blocking plate 62, an arm body 63, and a float 64. The detection arm 60 is configured to move, according to the amount of ink stored in the ink chamber 36, between a position where the light blocking plate 62 contacts the bottom wall 34A of the ink amount detection portion 34 (hereinafter referred to as a lower position) and a position where the light blocking plate 62 is separated from the bottom wall 34A and contacts the top wall 34D (hereinafter referred to as an upper position). In FIG. 2B, the detection arm 60 positioned in the lower position is indicated by a solid line, and the detection arm 60 positioned in the upper position is indicated by a broken line. Because the position of the light blocking plate 62 in the ink amount detection portion 34 can be seen visually, a user can recognize the amount of ink stored in the ink chamber 36. In addition, when the optical detector 114 detects the position of the light blocking plate 62 in the ink amount detection portion 34, a controller 90 can determine the amount of ink in the ink chamber 36.

The arm body 63 is an elongated rod-shaped member, and is pivotally supported by a shaft 66 extending between both sidewalls 41 of the ink cartridge 30 in the width direction 51. The arm body 63 is pivotable in the ink chamber 36 in directions indicated by arrows 67 and 68.

The float 64 is positioned at an end of the arm body 63 with respect to a removal direction 54 opposite to the insertion direction 50. The float 64 has a hollow interior formed therein, and a predetermined buoyancy acts on the float 64 when the float 64 is submerged in ink. Thus, the float 64 moves in the height direction 52 when the amount of ink stored in the ink chamber 36 increases or decreases. When the float 64 moves, the detection arm 60 pivots about the shaft 66. In another embodiment, the float 64 may not have a hollow interior therein, and a portion of the arm body 63 extending from the supporting shaft 66 to the float 64 and the float 64 may have the specific gravity less than the specific gravity of ink, such that a predetermined buoyancy acts thereon, or a portion of the portion of the arm body 63 extending from the supporting shaft 66 to the float 64 and the float 64 may have the specific gravity less than the specific gravity of ink, such that a predetermined buoyancy acts thereon.

The light-blocking panel 62 is positioned at an end of the arm body 63 with respect to the insertion direction 50, i.e., at an end opposite from the float 64. When the ink amount in the ink chamber 36 is greater than or equal to a predetermined amount, the detection arm 60 pivots clockwise, i.e., the direction indicated by the arrow 67, in FIG. 2B about the shaft 66 because of the buoyancy acting on the float 64, and the light-blocking panel 62 moves downward in the inner space 35. Then, the light-blocking panel 62 comes into contact with the bottom wall 34A of the ink amount detection portion 34 and remains in the lower position (the position indicated by the solid line in FIG. 2B). When the ink amount in the ink chamber 36 is reduced to the predetermined amount, a part of the float 64 is exposed from the ink surface, and the buoyancy is balanced out by the gravity. When the ink amount in the ink chamber 36 is further reduced to an amount less than the predetermined amount, the float 64 moves down as the ink surface in the ink chamber 36 is lowered. When this occurs, the detection arm 60 pivots counterclockwise i.e., the direction indicated by the arrow 68, in FIG. 2B about the shaft 66, and the light-blocking panel 62 moves upward in the inner space 35 and moves apart from the bottom wall 34A. Then, the light-blocking panel 62 comes into contact with the top wall 34D and remains in the upper position (the position indicated by the broken line in FIG. 2B).

The light-blocking panel 62 is aligned with the irradiated portion 34C in the width direction 51 when the light-blocking panel 62 is in the lower position. In contrast, when the light-blocking panel 62 is in the upper position, the light-blocking panel 62 is positioned above the irradiated portion 34C, and is not aligned with the irradiated portion 34C in the width direction 51.

Referring to FIGS. 2A and 2B, the ink cartridge 30 comprises the triggering portion 85. The triggering portion 85 is spaced apart from the ink amount detection portion 34 in the insertion direction 50. That is, the triggering portion 85 and the ink amount detection portion 34 are positioned, such that the triggering portion 85 is positioned further forward than the ink amount detection portion 34 in the insertion direction 50, and a space 86 is formed between the triggering portion 85 and the ink amount detection portion 34 in the insertion direction 50.

The triggering portion 85 has a U-shape in a side view and protruding from the bottom wall 34A and the top wall 34D of the ink amount detection portion 34, respectively. A width of the triggering portion 85 is substantially the same as the width of the ink amount detection portion 34 in the width direction 51, and is set, such that the triggering portion 85 can enter the detection area 115 of the optical detector 114 (FIG. 3). The triggering portion 85 is formed of an opaque material such that light is not allowed to pass therethrough in the width direction 51. Light can pass in the width direction 51 through the space 86 formed between the triggering portion 85 and the ink amount detection portion 34. The space 86 is defined at the same height as the irradiated portion 34C of the ink amount detection portion 34. In addition, the end of the triggering portion 85 with respect to the insertion direction 50 is offset in the removal direction 54 from each end of the first and second protruding members 75 and 76 with respect to the insertion direction 50. In other words, the dimension of the triggering portion 85 protruding from the front surface 40 in the insertion direction 50 is less than the dimension of each of the first and second protruding members 75 and 76 protruding from the front surface 40 in the insertion direction 50.

The ink cartridge 30 comprises the air communication opening 71 and the ink supply portion 72 at the front surface 40. The air communication opening 71 is positioned above the ink amount detection portion 34 at the front surface 40. The air communication opening 71 is formed through the front surface 40 and provides communication between an exterior of the ink cartridge 30 and the ink chamber 36. The air communication opening 71 allows air to be introduced from the exterior of the ink cartridge 30 to the ink chamber 36. When the ink cartridge 30 is in an unused state (for example, when the ink cartridge 30 is shipped from a factory), the air communication opening 71 is sealed with a sticker or the like from the outside. Therefore, if the ink chamber 36 is depressurized for example, the depressurized state is maintained. When the ink cartridge 30 is used, the sticker is torn or removed, and hence the ink chamber 36 is brought into an atmospheric pressure.

The ink supply portion 72 is positioned below the ink amount detection portion 34. The ink supply portion 72 is formed of a tubular member having elasticity and protrudes outward, or in the insertion direction 50, from the front surface 40. The ink supply portion 72 has a through hole 73 formed through the center thereof. Ink in the ink chamber 36 is supplied to the exterior of the ink cartridge 30 via the through hole 73.

The ink cartridge 30 comprises a rib 43 extending in the depth direction 53. The rib 43 protrudes upward from a top wall 39 of the ink cartridge 30. An engaging surface 45 of the rib 43 is positioned apart from the front surface 40 in the removal direction 54, and is positioned at about a middle portion of the top wall 39 in the depth direction 53.

The ink cartridge 30 comprises the first protruding member 75 and the second protruding member 76. The first protruding member 75 is integrally formed with the rib 43 at an upper end of the front surface 40. The width of the first protruding member 75 is the same as the width of the front surface 40 in the width direction 51, and the first protruding member 75 protrudes from the front surface 40 in the insertion direction 50. In the insertion direction 50, an end of the first protruding member 75 is positioned further forward than an end of the ink supply portion 72. In other words, a dimension of the first protruding member 75 protruding from the front surface 40 in the insertion direction 50 is greater than a dimension of the ink supply portion 72 protruding from the front surface 40 in the insertion direction 50. In the insertion direction 50, the end of the first protruding member 75 is positioned further forward than ends of the ink amount detection portion 34 and the triggering portion 85. In other words, the dimension of the first protruding member 75 protruding from the front surface 40 in the insertion direction 50 is greater than dimensions of the ink amount detection portion 34 and the triggering portion 85 protruding from the front surface 40 in the insertion direction 50.

The first protruding member 75 has a recess formed in its lower surface. The recess is substantially rectangular in cross section taken along the width direction 51 and the height direction 52, and is open downward. The recess extends along the depth direction 53 from the end of the first protruding member 75 in the depth direction 53. The first protruding member 75 comprises a rib 77 extending in the depth direction 53 in the recess. The rib 77 is positioned at a middle portion of the recess in the width direction 51. The width of the rib 77 is set, such that the rib 77 can enter a detection area 109 of an optical detector 107 (FIG. 3). The rib 77 is formed of an opaque material configured to block light emitted from the optical detector 107.

The rib 77 has a cut-out 78 formed therein. The cut-out 78 passes through the rib 77 in the width direction 51. The cut-out 78 is positioned at the same position as the end of the triggering portion 85 in the depth direction 53. In other words, the end of the triggering portion 85 and the cut-out 78 are aligned in the height direction 52. The cut-out 78 allows light emitted from the optical detector 107 to pass therethrough.

The second protruding member 76 is positioned at a lower end of the front surface 40. The width of the second protruding member 76 is the same as the width of the front surface 40 in the width direction 51. The second protruding member 76 protrudes from the front surface 40 in the insertion direction 50. In the insertion direction 50, an end of the second protruding member 76 is positioned further forward than the end of the ink supply portion 72. In other words, a dimension of the second protruding member 76 protruding from the front surface 40 in the insertion direction 50 is greater than the dimension of the ink supply portion 72 protruding from the front surface 40 in the insertion direction 50. In the insertion direction 50, the end of the second protruding member 76 is positioned further forward than the ends of the ink amount detection portion 34 and the triggering portion 85. In other words, the dimension of the second protruding member 76 protruding from the front surface 40 in the insertion direction 50 is greater than the dimensions of the ink amount detection portion 34 and the triggering portion 85 protruding from the front surface 40 in the insertion direction 50.

The second protruding member 76 has a recess formed in its upper surface. The recess is substantially rectangular in cross section taken along the width direction 51 and the height direction 52, and is open upward. The recess extends along the depth direction from the end of the second protruding member 76 in the depth direction 53. The second protruding member 76 comprises a rib 80 extending in the depth direction 53 in the recess. The rib 80 is positioned at a middle portion of the recess in the width direction 51. The width of the rib 80 is set, such that the rib 80 can enter a detection area 120 of an optical detector 118 (FIG. 3). The rib 80 is formed of an opaque material configured to block light emitted from the optical detector 118.

The rib 80 has a cut-out 81 formed therein. The cut-out 81 passes through the rib 80 in the width direction 51. The cut-out 81 is positioned at the same position as the end of the triggering portion 85 in the depth direction 53. In other words, the end of the triggering portion 85 and the cut-out 81 are aligned in the height direction 52. The cut-out 81 allows light emitted from the optical detector 118 to pass therethrough.

Referring to FIG. 3, the cartridge holder 110 is configured to accommodate the ink cartridges 30 in the interior thereof. The cartridge holder 110 has an opening 112 at the front side of the printer 12 (left side in FIG. 3). The ink cartridges 30 are inserted into the cartridge holder 110 through the opening 112. A direction in which the ink cartridge 30 is inserted into the cartridge holder 110 is referred to as the insertion direction 50, the direction in which the ink cartridge 30 is removed from the cartridge holder 110 is referred to as the removal direction 54, and the directions along the insertion direction 50 and the removal direction 54 is referred to as insertion/removal directions 105. The cartridge holder 110 allows the four ink cartridges 30 to be mounted thereto. Although a structure of the cartridge holder 110 for one of the ink cartridges 30 to be mounted to the cartridge holder 110 is described below, the structure described below is provided for each of the ink cartridges 30 to be mounted to the cartridge holder 110. In other words, in the cartridge holder 110, the respective components described below are provided on the cartridge holder 110 corresponding to the four ink cartridges 30 storing respective color inks.

Referring to FIG. 3, the cartridge holder 110 includes an end wall 117 opposite the opening 112. The optical detector 114 is positioned at a substantially middle portion of the end wall 117 with respect to the height direction 52. The optical detector 114 protrudes from the end wall 117 toward the opening 112 along the insertion/removal direction 105. The optical detector 114 is configured to selectively detect the light-blocking plate 62 positioned in the ink amount detection portion 34 and the triggering portion 85 of the ink cartridge 30. Thus, the optical detector 114 is positioned at the same height as the ink amount detection portion 34 and the triggering portion 85 of the ink cartridge 30 to be mounted in the cartridge holder 110. The triggering portion 85 and the ink amount detection portion 34 of the ink cartridge 30 enter the detection area 115 of the optical detector 114 in this order during the insertion of the ink cartridge 30 into the cartridge holder 110.

Figure 4:
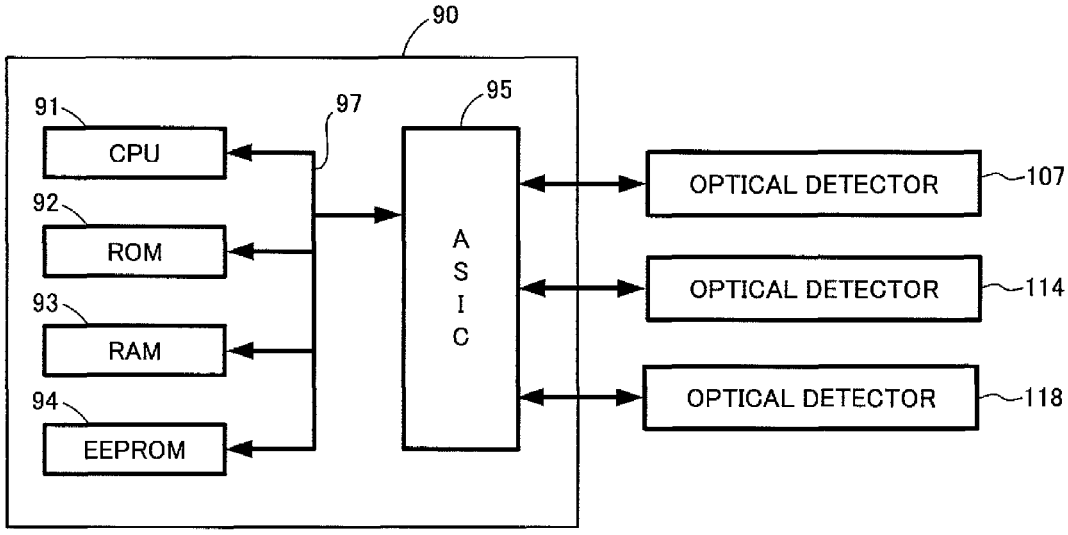
FIG. 4 is a block diagram of an electrical configuration of a controller.

The optical detector 114 is a transmissive photo-interrupter comprising a light emitting portion (not shown) configured to emit light, e.g., visible light or infrared light, and a light receiving portion (not shown) configured to receive light emitted from the light emitting portion. The light emitting portion comprises a light emitting diode, and the light receiving portion comprises a photo transistor. The light emitting portion and the light receiving portion are positioned so as to face each other in the width direction 51, and an optical path extending from the light emitting portion to the light receiving portion corresponds to the detection area 115. When the light blocking plate 62 positioned in the ink amount detection portion 34 or the triggering portion 85 enters the detection area 115 and blocks the light in the detection area 115, i.e., when the light blocking plate 62 positioned in the ink amount detection portion 34 or the triggering portion 85 is detected by the optical detector 114, the intensity of light received by the light receiving portion changes, which causes a signal output from the optical detector 114 to change. The signal output from the optical detector 114 is sent to the controller 90 (FIG. 4).

Referring to FIG. 3, the optical detector 107 is positioned in an upper portion of the end wall 117 of the cartridge holder 110. An opening 108 is formed through the upper portion of the end wall 117. The opening 108 is formed through the end wall 117 in the insertion/removal direction 105. The opening 108 has a width and a height which are greater than those of the first protruding member 75 of the ink cartridge 30. Thus, the first protruding member 75 is allowed to pass through the opening 108 and protrude from the end wall 117 in the insertion direction 50.

The optical detector 107 extends through the opening 108 toward the opening 112. The optical detector 107 is configured to detect the rib 77 of the first protruding member 75 of the ink cartridge 30. When the ink cartridge 30 is mounted in a mount positioned, described below, in the cartridge holder 110, the cut-out 78 of the rib 77 is positioned in front of the detection area 109 in the insertion direction 50. In other words, when the ink cartridge 30 is in the mount position, the detection area 109 is positioned closer to the front surface 40 than the cut-out 78 is. The cut-out 78 enters the detection area 109 of the optical detector 107 during the insertion of the ink cartridge 30 into the cartridge holder 110.

Similarly to the optical detector 114, the optical detector 107 is a transmissive photo-interrupter comprising a light emitting portion (not shown) configured to emit light, e.g., visible light or infrared light, and a light receiving portion (not shown) configured to receive light emitted from the light emitting portion. In the optical detector 107, an optical path extending from the light emitting portion to the light receiving portion corresponds to the detection area 109. When the rib 77 enters the detection area 109 and blocks the light in the detection area 109, i.e., when the rib 77 is detected by the optical detector 107, the intensity of light received by the light receiving portion changes, which causes a signal output from the optical detector 107 to change. The signal output from the optical detector 107 is sent to the controller 90 (FIG. 4).

Referring to FIG. 3, the optical detector 118 is positioned in a lower portion of the end wall 117 of the cartridge holder 110. An opening 119 is formed through the lower portion of the end wall 117. The opening 119 is formed through the end wall 117 in the insertion/removal direction 105. The opening 119 has a width and a height which are greater than those of the second protruding member 76 of the ink cartridge 30. Thus, the second protruding member 76 is allowed to pass through the opening 119 and protrude from the end wall 117 in the insertion direction 50.

The optical detector 118 extends through the opening 119 toward the opening 112. The optical detector 118 is configured to detect the rib 80 of the second protruding member 76 of the ink cartridge 30. When the ink cartridge 30 is mounted in the mount position in the cartridge holder 110, the cut-out 81 of the rib 80 is positioned in front of the detection area 120 in the insertion direction 50. In other words, when the ink cartridge 30 is in the mount position, the detection area 120 is positioned closer to the front surface 40 than the cut-out 81 is. The cut-out 81 enters the detection area 120 of the optical detector 118 during the insertion of the ink cartridge 30 into the cartridge holder 110.

Similarly to the optical detector 114, the optical detector 118 is a transmissive photo-interrupter comprising a light emitting portion (not shown) configured to emit light, e.g., visible light or infrared light, and a light receiving portion (not shown) configured to receive light emitted from the light emitting portion. In the optical detector 118, an optical path extending from the light emitting portion to the light receiving portion corresponds to the detection area 120. When the rib 80 enters the detection area 120 and blocks the light in the detection area 120, i.e., when the rib 80 is detected by the optical detector 118, the intensity of light received by the light receiving portion changes, which causes a signal output from the optical detector 118 to change. The signal output from the optical detector 118 is sent to the controller 90 (FIG. 3).

Referring to FIG. 3, the cartridge holder 110 comprises a lock mechanism 144. The lock mechanism 144 is configured to place the ink cartridge 30 in the mount position in the cartridge holder 110 and prevent the ink cartridge 30 from moving in the removal direction 54. The ink cartridge 30 is retained in the mount position in the cartridge holder 110. When the ink cartridge 30 is in the mount position, ink is allowed to be supplied from the ink chamber 36 to the recording head 21 via the cartridge holder 110.

The lock mechanism 144 is positioned in an upper portion of the cartridge holder 110 adjacent to the opening 112. The lock mechanism 144 comprises a lock lever 145 and a coil spring 148. The lock lever 145 is supported by a support shaft (not shown) and is configured to move between an unlock position illustrated in FIGS. 5A and 5B and a lock position illustrated in FIG. 3. The coil spring 148 is configured to urge the lock lever 145 toward the lock position. An end of the lock lever 145 facing the insertion direction 50 is an engaging end 146. The engaging end 146 is configured to contact the engaging surface 45 of the ink cartridge 30, such that the ink cartridge 30 is prevented from moving in the removal direction 54, i.e., the ink cartridge 30 is locked in the mount position.

The lock lever 145 comprises an operating portion 147 at an end opposite to the engaging end 146. When the operating portion 147 is lowered, the lock lever 145 in the lock position is moved to the unlock position against an urging force of the coil spring 148. In this state, the ink cartridge 30 can be removed from the cartridge holder 110.

Referring to FIG. 3, an opening 113 is formed through the lower portion of the end wall 117 from the inner surface of the end wall 117 to the outer surface of the end wall 117. A connecting portion 121 and an ink supply tube 122 are provided at the inner surface of the end wall 117 so as to be in fluid communication with the opening 113. The flexible ink tube 20 (see FIG. 1) is connected to the outer surface of the end wall 117 so as to be in fluid communication with the opening 113. When the ink cartridge 30 is mounted to the cartridge holder 110 in the mount position, the ink supply tube 122 is inserted into the through hole 73 of the ink supply portion 72. Accordingly, an ink path extending from the ink chamber 36 of the ink cartridge 30 via the through hole 73 of the ink supply portion 72 and the ink supply tube 122 to the connecting portion 121 is formed, and the ink stored in the ink chamber 36 is supplied to the recording head 21 via the ink tube 20.

A rod 124 is provided at the upper portion of the end wall 117. The rod 124 projects from the end wall 117 toward the opening 112 in the removal direction 54. When the ink cartridge 30 is mounted to the cartridge holder 110, the rod 124 is inserted into the air communication opening 71. Accordingly, a seal member which has sealed the air communication opening 71 is torn, and the ink chamber 36 is brought into fluid communication with the atmosphere.

Referring to FIG. 4, the controller 90 is configured to execute a first process based on the signals output from the optical detectors 107 and 118 when the triggering portion 85 is detected by the optical detector 114 during the insertion of the ink cartridge 30 into the cartridge holder 110, and execute a second process based on the signals output from the optical detectors 107 and 118 when the light-blocking plate 62 in the ink amount detection portion 34 is detected during the insertion of the ink cartridge 30 into the cartridge holder 110. The type of the ink cartridge 30 is determined in the first process, and it is determined that the ink cartridge 30 has reached the mount position in the second process.

In this embodiment, the controller 90 is configured to control the entire operation of the printer 12. Nevertheless, because configurations relating to control of the recording head 21 and the pickup roller 23 etc. do not relate directly to the present invention, detailed description thereof is omitted.

Referring to FIG. 4, the controller 90 is configured as a microcomputer comprising a central processing unit (CPU) 91, read-only memory (ROM) 92, random access memory (RAM) 93, erasable programmable read only memory (EEPROM) 94, and an application-specific integrated circuit (ASIC) 95.

The ROM 92 stores programs for the CPU 91 to control various operations of the printer 12, programs for the CPU 91 to execute the first process and the second process, and a table of one-to-one correspondence between the types of ink cartridge 30 and output signals of the optical detectors 107 and 118. The RAM 93 is used as a storage area for temporality storing data or signals or a work area for the data processing for the CPU 91 to execute the programs described above. The EEPROM 94 stores settings, flags, and the like which are to be retained even after the printer 12 is turned OFF.

The CPU 91, the ROM 92, the RAM 93, and the EEPROM 94 are electrically connected to the ASIC 95 via a bus 97 so as to be capable of communicating with each other. The optical detectors 107, 114, 118 are electrically connected to the ASIC 95, such that the optical detectors 107, 114, 118 can output signals to the ASIC 95.

Each optical detector 107, 114, 118 is configured to output an analog electric signal, e.g. a voltage or current signal, corresponding to the intensity of light received by the light receiving portion. When the electrical level, e.g. a voltage or current value of the signal output from the optical detector 107, 114, or 118, is greater than or equal to a predetermined threshold value, the controller 90 determines that the signal is as a HI level signal, and when the electrical level is less than the predetermined threshold value, the controller 90 determines that the signal is a LOW level signal. In the embodiment, the signal output from each optical detector 107, 114, 118 is determined as the LOW level signal when the light emitted from the light emitting portion is blocked in the detection area 109, 115, 120, and determined as the HI level signal when the light is not blocked. In this embodiment, the LOW level signal output from the optical detector 107 corresponds to first detection information, and the LOW level signal output from the optical detector 118 corresponds to second detection information. The LOW level signal output from the optical detector 114 firstly during the insertion of the ink cartridge 30 into the cartridge holder 110 corresponds to third detection information, and the LOW level signal output from the optical detector 114 secondly during the insertion of the ink cartridge 30 into the cartridge holder 110 corresponds to fourth detection information. In other words, the LOW level signal output from the optical detector 114 when the triggering portion 85 is detected corresponds to third detection information, and the LOW level signal output from the optical detector 114 when the light blocking plate 62 in the ink amount detection portion 34 is detected corresponds to fourth detection information.

Figure 5A:
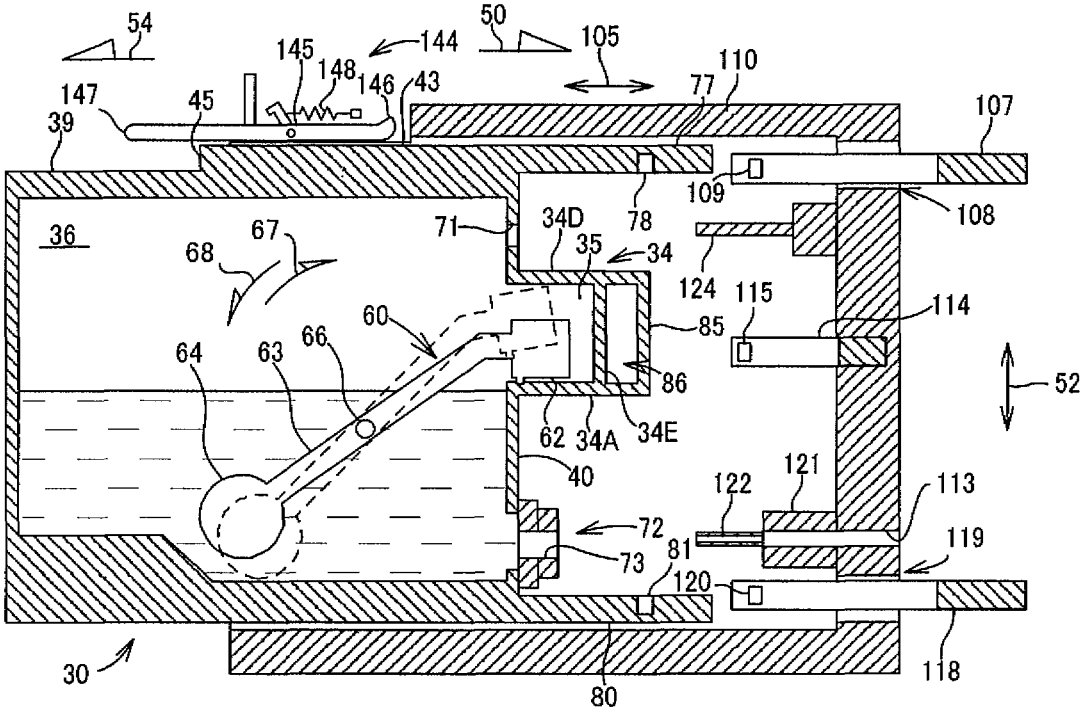
FIG. 5A is a vertical cross-sectional view of the ink cartridge of FIGS. 2A and 2B and the cartridge holder of FIG. 3, in which the ink cartridge is inserted into the cartridge holder.

Referring to FIG. 5A, when the ink cartridge 30 is inserted into the cartridge holder 110 in the insertion direction 50, the first protruding member 75 contacts the engaging end 146 of the lock lever 145. When this occurs, the lock lever 145 rotates counterclockwise, the engaging end 146 moves upward, and the position of the lock lever 145 changes from the lock position to the unlock position.

Figure 5B:
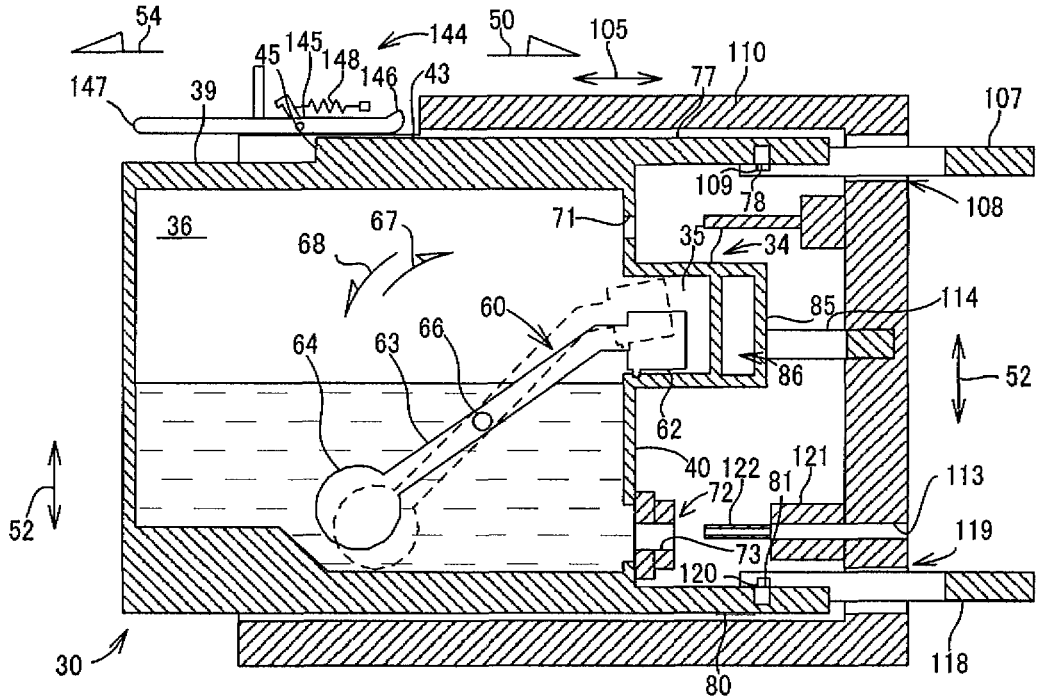
FIG. 5B is a vertical cross-sectional view of the ink cartridge and the cartridge holder, in which the ink cartridge is further inserted into the cartridge holder from the state shown in FIG. 5A.
Figure 7:
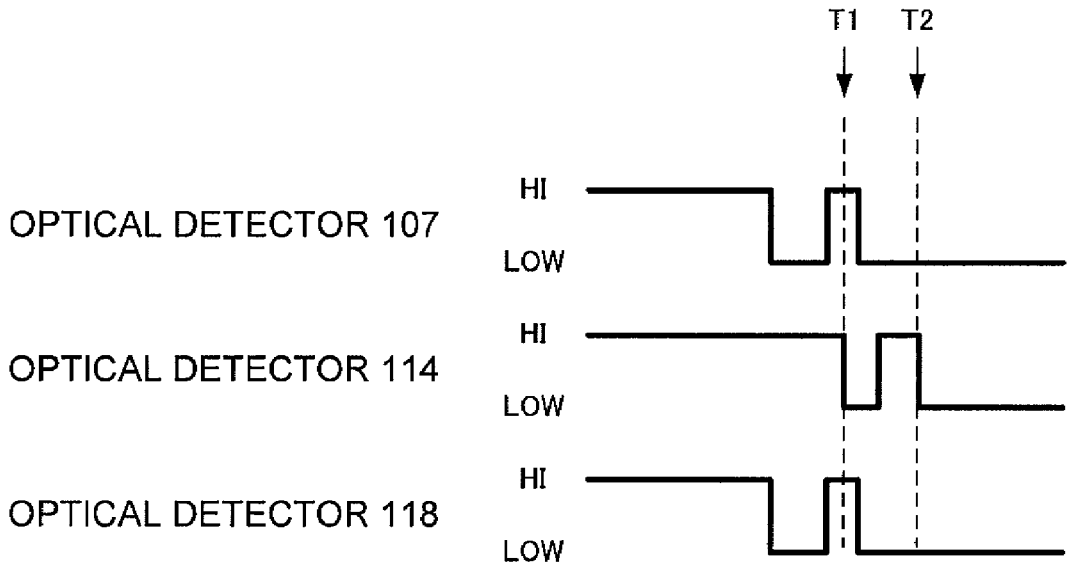
FIG. 7 is time profiles of output signals from optical detectors during an insertion of the ink cartridge into the cartridge holder.

Referring to FIG. 5B, when the ink cartridge 30 is further inserted in the insertion direction 50, the triggering portion 85 enters the detection area 115 of the optical detector 114, and then the signal output from the optical detector 114 changes from the HI level signal to the LOW level signal (T1 in FIG. 7). In other words, the controller 90 determines that the optical detector 114 detects the triggering portion 85 (S1:Yes in FIG. 8).

Figure 8:
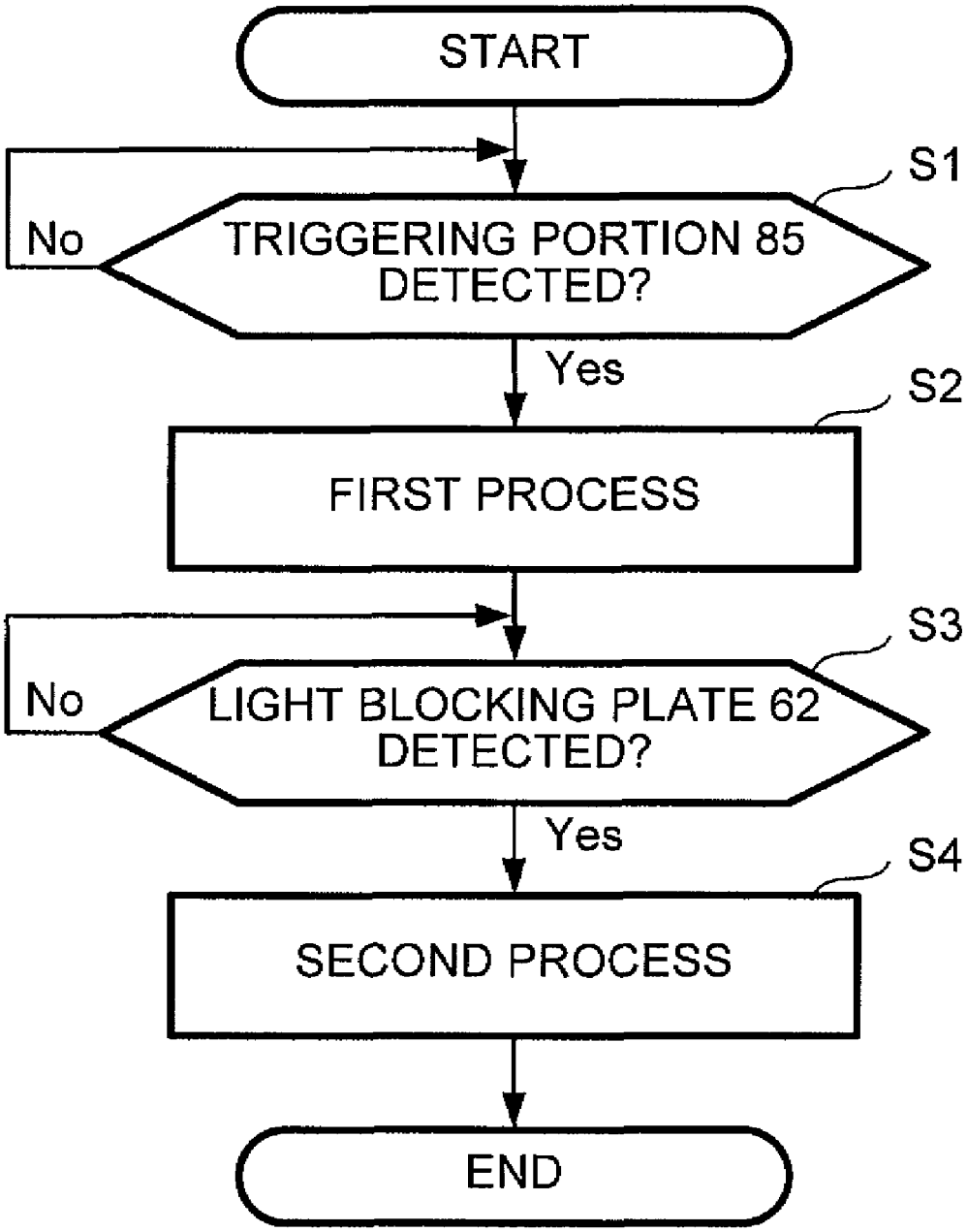
FIG. 8 is a flowchart of processes executed by a controller.

When the controller 90 determines that the optical detector 114 detects the triggering portion 85, it executes the first process in which the type of the ink cartridge 30 is determined (S2 in FIG. 8). In the ink cartridge 30 storing black ink, the first protruding member 75 comprises the rib 77 having the cut-out 78 formed therein, and the second protruding member 76 comprises the rib 80 having the cut-out 81 formed therein. Thus, when the controller 90 determines that the optical detector 114 detects the triggering portion 85, the cut-out 78 is in the detection area 109 of the optical detector 107 and the cut-out 81 is in the detection area 120 of the optical detector 118. In other words, when the controller 90 determines that the optical detector 114 detects the triggering portion 85, the signal output from the optical detector 107 has changed from the LOW level signal to the HI level signal and the signal output from the optical detector 118 has changed from the LOW level signal to the HI level signal (T1 in FIG. 7). The controller 90 checks the output signals of the optical detectors 107, 118, i.e., the combination of (HI, HI), in the table stored in the ROM 92, to determine the type of ink cartridge 30 inserted into the cartridge holder 110. In this example, the controller 90 determines that the ink cartridge 30 inserted into the cartridge holder 110 is the ink cartridge 30 storing black ink.

When the ink cartridge 30 is further inserted in the insertion direction 50, the triggering portion 85 passes over the detection area 115 of the optical detector 114. At this time, the signal output from the optical detector 114 changes from the LOW level signal to the HI level signal (FIG. 7). In addition, the cut-out 78 formed in the rib 77 of the first protruding member 75 passes over the detection area 109 of the optical detector 107, and the cut-out 81 formed in the rib 80 of the second protruding member 76 passes over the detection area 120 of the optical detector 118. Thus, the signal output from each optical detector 107, 118 changes from the HI level signal to the LOW level signal (FIG. 7).

Referring to FIG. 9, when the ink cartridge 30 is inserted all the way into the cartridge holder 110 and reaches the mount position, the irradiation portion 34C of the ink amount detection portion 34 has already entered the detection area 115 of the optical detector 114. When the ink cartridge 30 is new or unused, it stores the predetermined amount or more of ink in the ink chamber 36 and the light blocking plate 62 of the detection arm 60 is positioned in the lower position and blocks the light in the detection area 115. Thus, the signal output from the optical detector 114 has changed from the HI level signal to the LOW level signal. In other words, the controller 90 determines that the optical detector 114 detects the light blocking plate 62 in the ink amount detection portion 34.

When the controller 90 determines that the optical detector 114 detects the light blocking plate 62 in the ink amount detection portion 34 (S3:Yes in FIG. 8), it executes the second process (S4 in FIG. 8). When the controller 90 determines that the optical detector 114 detects the light blocking plate 62 in the ink amount detection portion 34, the output signals of the optical detectors 107 and 118 are both the LOW level signals (T2 in FIG. 7). When the output signals of the optical detectors 107 and 118 are both the LOW level signals, the controller 90 executes the second process, i.e., the controller 90 determines that the ink cartridge 30 has reached the mount position (S4 in FIG. 8). If at least one of the output signals of the optical detectors 107 and 118 is not the LOW level signal when the controller 90 determines that the optical detector 114 detects the light blocking plate 62 in the ink amount detection portion 34, the controller 90 determines that the ink cartridge 30 has a defect, or that the mounting of the ink cartridge 30 into the cartridge holder 110 failed.

When the ink cartridge 30 reaches the mount position, the engaging surface 45 of the rib 43 passes over the engaging end 146 of the lock lever 145. When this occurs, because the engaging end 146 of the lock lever 145 is not supported by the rib 43, the lock lever 145 in the unlock position rotates to the lock position by the urging force of the coil spring 148, and the engaging end 146 of the lock lever 145 contacts the engaging surface 45 of the rib 43, such that the ink cartridge 30 is locked in the removal direction 54 and retained in the mount position.

As described above, when the ink cartridge 30 is mounted in the cartridge holder 110, the ink supply tube 122 is inserted into the through hole 73 of the ink supply portion 72, and ink stored in the ink chamber 36 is supplied to the recording head 21 via the ink tube 20. The rod 124 is inserted into the air communication opening 71 and the ink chamber 36 is in communication with the atmosphere.

When ink is supplied from the ink cartridge 30 mounted in the cartridge holder 110 and then the amount of ink remaining in the ink chamber 36 becomes less than the predetermined amount, the light blocking plate 62 of the detection arm 60 moves from the lower position to the upper position. Accordingly, the output signal of the optical detector 114 changes from the LOW level signal to the HI level signal, and the controller 90 determines that the amount of ink remaining in the ink chamber 36 becomes low.

As described above, in the ink cartridge 30 storing black ink, the cut-outs 78 and 81 are formed in the ribs 77 and 80 respectively. Because of the cut-outs 78 and 81, the signals output from the optical detectors 107 and 118 are both the HI level signals in the first process. In the ink cartridge storing cyan ink, the cut-out 78 is formed in the rib 77, but the cut-out 81 is not formed in the rib 80. Therefore, the signal output from the optical detector 107 is the HI level signal, and the signal output from the optical detector 118 is the LOW level signal in the first process. In the ink cartridge storing magenta ink, the cut-out 78 is not formed in the rib 77, but the cut-out 81 is formed in the rib 80. Therefore, the signal output from the optical detector 107 is the LOW level signal, and the signal output from the optical detector 118 is the HI level signal in the first process. In the ink cartridge storing yellow ink, the cut-out 78 is not formed in the rib 77, and the cut-out 81 is not formed in the rib 80. Therefore, the signal output from the optical detector 107 is the HI level signal, and the signal output from the optical detector 118 is the HI level signal in the first process. There are four combinations of the signals output from the optical detectors 107 and 118 in the first process: (HI, HI), (HI, LOW), (LOW, HI), and (LOW, LOW), and the type of the ink cartridge 30 among four types is determined in the first process.

Figure 6:
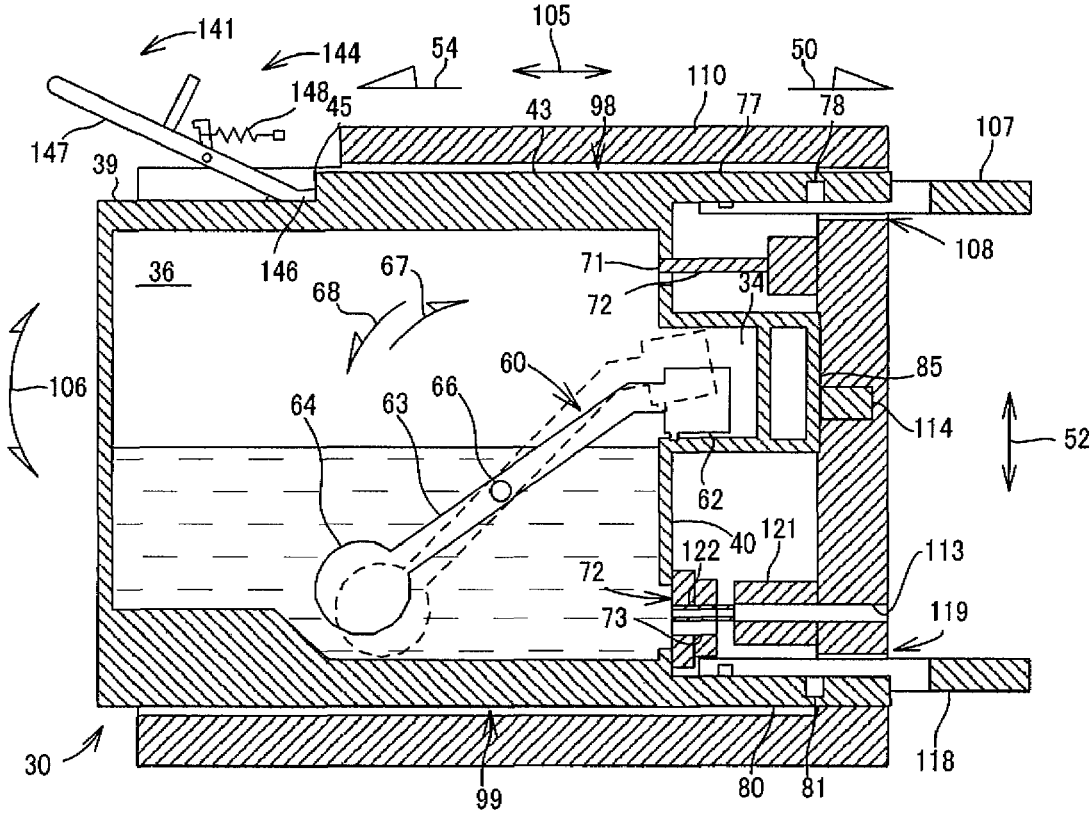
FIG. 6 is a vertical cross-sectional view of the ink cartridge and the cartridge holder, in which the ink cartridge is in a mount position.

Referring to FIG. 6, the dimensions of an inner space of the cartridge holder 110 in which the ink cartridge 30 is to be mounted are set to be slightly greater than dimensions of the outer shape of the ink cartridge 30 thereby facilitating insertion of the ink cartridge 30 into the cartridge holder 110. Thus, gaps 98 and 99 are formed between the inner walls of the cartridge holder 110 and the ink cartridge 30 mounted in the cartridge holder 110, and the ink cartridge 30 rattles in the cartridge holder 110 to some degree in a direction indicated by arrows 106. However, because the triggering portion 85 is positioned between the first protruding member 75 and the second protruding member 76, the positional change of the ink cartridge 30 in the cartridge holder 110 has little effect on the positional relationship between the triggering portion 85 and the first and second protruding member 75, 76.

As described above, the triggering portion 85 is positioned between the first protruding member 75 and the second protruding member 76 and the controller 90 executes the first process when detecting the triggering portion 85. With this configuration, the effect of the positional change or rattle of the ink cartridge 30 in the cartridge holder 110 on the positional relationship between the triggering portion 85 and the first and second protruding member 75, 76 can be reduced. Thus, in the first process, the ribs 77 and 80 formed in the ink cartridge 30 are correctly detected and the type of ink cartridge 30 can be correctly determined.

The ink amount detection portion 34 and the triggering portion 85 are aligned in the insertion direction 50 and detected in order by the optical detector 114. Thus, a dimension in which the ink amount detection portion 34 and the triggering portion 85 are allowed to be oriented in the insertion direction 50 is small. The triggering portion 85, which is realized with such a relatively small dimension in the insertion direction 50, is configured to trigger the first process. The first and second protruding members 75 and 76, which have relatively large design dimension, are configured to provide the controller 90 with information indicating the type of ink cartridge 30. With this configuration, the first process is correctly executed.

Similarly the light blocking plate 62 in the ink amount detection portion 34 is configured to trigger the second process, and the first and second protruding members 75 and 76, which have relatively large design dimension, are configured to provide the controller 90 with information indicating that the ink cartridge 30 has reached the mount position. With this configuration, the second process is correctly executed.

In the embodiment, the first protruding member 75 and the second protruding member 76 are formed integrally with the ink cartridge 30. However, the first protruding member 75 and the second protruding member 76 may be configured to be removably attached to the ink cartage 30.

In the embodiment, the type of the ink cartridge 30 relates to the color of ink stored in the ink cartridge 30. In another embodiment, the type of ink cartridge 30 may relate to the initial amount of ink stored in the ink cartridge 30.

In another embodiment, the type of the ink cartridge 30 may relate to the composition of ink. Ink may include a pigment or a dye, or the composition of ink may be tailored for cold climate areas or for tropical regions. When the composition of the ink changes, the viscosity or the surface tension of the ink changes accordingly. Therefore, if the composition of the ink is changed, it may be necessary to change the control of the ink discharge in the recording head 21 correspondingly. In the embodiment in which the composition of the ink is determined, the image recording is performed with an optimal discharge control in the recording head 21.

In another embodiment, the type of the ink cartridges 30 may relate to the place of manufacture of the ink. When the place of manufacture is determined, such information is stored in the controller 90. If a quality problem occurs in the printer 12, and the printer 12 is returned to the manufacturer, the manufacturer can know the place of manufacture of the ink used in the returned printer 12 based on the information stored in the controller 90. Accordingly, studies of the quality problem may become easier. The cartridge type may be divided into two types: an ink cartridge 30 for general use and an ink cartridge 30 for maintenance. The ink cartridge 30 for maintenance is used by a serviceperson who repairs the printer 12. When the ink cartridge 30 for maintenance is mounted in the printer 12, a special operation that can not be done by a general user, for example, purging using high-capacity ink, is allowed in the controller 90.

In another embodiment, the type of the ink cartridges 30 may relate to the date of manufacture of the ink. When the date of manufacture is determined, such information is stored in the controller 90. If a quality problem occurs in the printer 12, and the printer 12 is returned to the manufacturer, the manufacturer can know the date of manufacture of the ink used in the returned printer 12 based on the information stored in the controller 90. Accordingly, studies of the quality problem may become easier. The first process may be used to make a distinction between an ink cartridge 30 for general use and an ink cartridge 30 for maintenance. The ink cartridge 30 for maintenance is used by a serviceperson who repairs the printer 12. When the ink cartridge 30 for maintenance is mounted in the printer 12, a special operation that can not be done by a general user, for example, purging using high-capacity ink, is allowed in the controller 90.

In another embodiment, the types of the ink cartridges 30 may relate to ink cartridge 30 for general user's use and ink cartridge 30 for maintenance operator's use. The maintenance operator is a person who is able to repair the printer 12 at the site of use. The maintenance operator may perform a special operation for repairing the printer 12. For example, when the ink cartridge 30 for the maintenance operator's use is mounted to the printer 12, special operations which cannot be performed by the general users such as a purge operation discharging a large amount of ink are authorized by the controller 90.

In another embodiment, the type of the ink cartridge may relate to air solubility of ink. If the ink has a low air-solubility, the ink chamber 36 may not be depressurized. In contrast, if the ink has a high air-solubility, the ink chamber 36 may be depressurized. A program for maintaining the recording head 21 is changed based on the determination of the type relating to air solubility of ink.

In this embodiment, the ribs 77 and 80 and the triggering portion 85 are configured to prevent the lights emitted from the light-emitting portions of the optical detectors 107, 114, 118, from passing therethrough. In another embodiment, the ribs 77 and 80 and the triggering portion 85 may be configured to alter the direction of light, e.g., reflect or diffract the entirety or a portion of light, such that the intensity of light received by the light-receiving portion is reduced. The ribs 77 and 80 and the triggering portion 85 may be a smoke glass or an aperture configured to attenuate light, such that the intensity of light received by the light-receiving portion is reduced.

In this embodiment, the triggering portion 85 and the cut-outs 78 and 81 are aligned in the height direction 52, such that the cut-outs 78 and 81 are detected by the optical detectors 107 and 108 at the same timing. However, the positioned of the cut portions 78 and 81 are not limited to those illustrated in this embodiment.

Figure 9A:
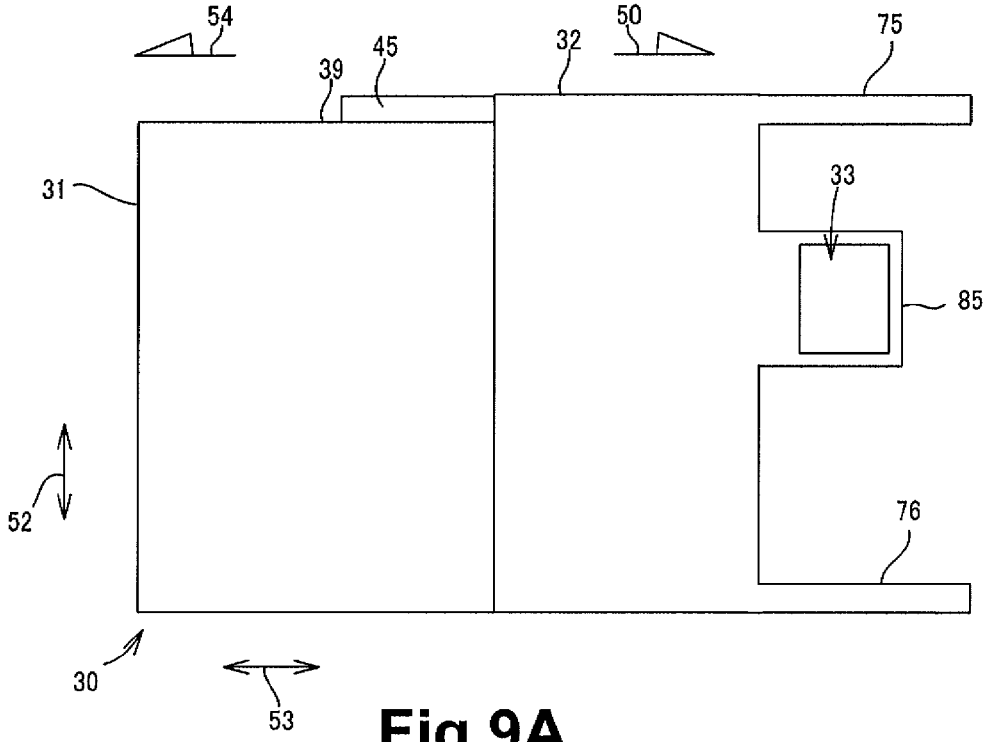
FIG. 9A is a side view of an ink cartridge according to another embodiment of the present invention.
Figure 9B:
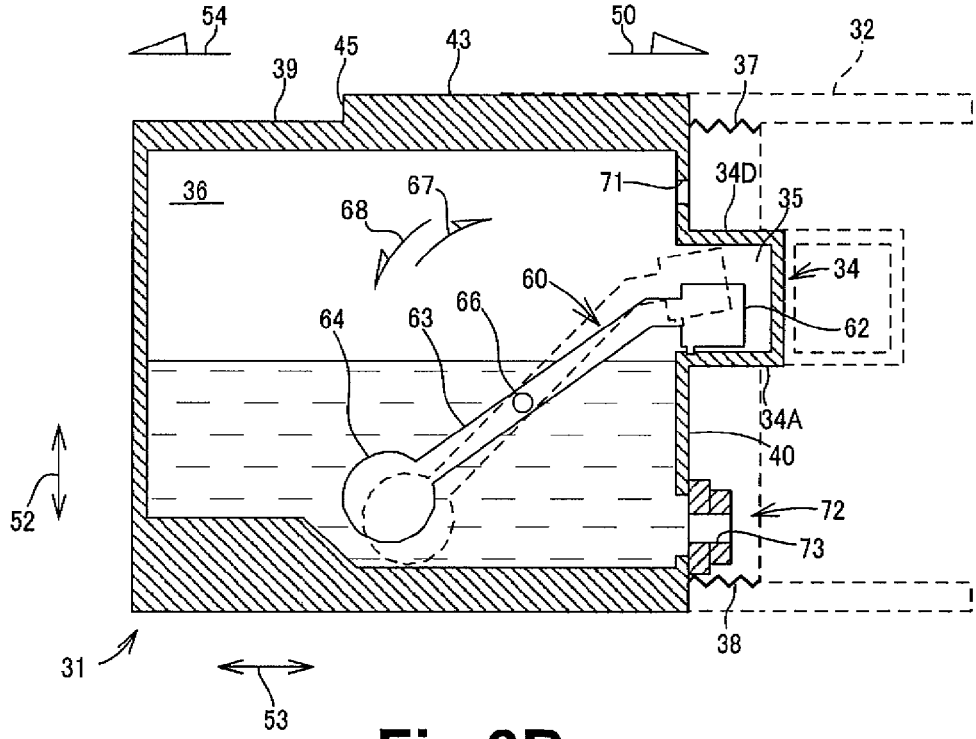
FIG. 9B is a vertical cross-sectional view of the ink cartridge.

Referring to FIGS. 9A and 9B, in a modified embodiment, the ink cartridge 30 comprises a case 31 comprising the ink chamber 36, and a cover 32 configured to cover a front side of the case 31 with respect to the insertion direction 50.

The case 31 has the same structure as the ink cartridge 30 described in the above embodiment, except that the case 31 does not comprise the first protruding member 75 and the second protruding member 76. Therefore, the case 31 has substantially a rectangular parallelepiped shape being thin in the width direction 51, and comprises ink chamber 36 therein. The case 31 comprises the ink amount detection portion 34, the air communication opening 71, and the ink supply portion 72 at the front side of the case 31 in the insertion direction 50.

The cover 32 has a hollow rectangular box shape and covers the front side of the case 31. The cover 32 is configured to slide on the outer surface of the front side of the case 31 in the insertion direction 50 and the removing direction 54, so as to move relative to the case 31. The cover 32 is hooked to the case 31 at a position apart from the case 31 in the insertion direction 50 by a predetermined distance, such that a range of sliding movement is limited. Coil springs 37 and 38 are interposed between the case 31 and the cover 32. The cover 32 is urged in a direction away from the case 31 by the coil springs 37 and 38.

The front side of the cover 32 in the insertion direction 50 is provided with the first protruding member 75, the second protruding member 76, and the triggering portion 85, which are similar to those described in the above-described embodiment. An opening 33 is formed at a position at the rear of the triggering portion 85 in the insertion direction 50. The opening 33 passes through the cover 32 in the width direction 51. When the cover 32 moves and is positioned closest to the case 31, the ink amount detection portion 34 enters a position corresponding to the opening 33, and the ink amount detection portion 34 is exposed to the outside of the cover 32 through the opening 33. When the cover 32 moves away from the case 31, the ink amount detection portion 34 moves out of the positioned corresponding to the opening 33, and the ink amount detection portion 34 is covered by the cover 32. The opening 33 is configured to allow light of the optical detector 114 to pass therethrough.

The cover 32 comprises a though hole through which the rod 124 can pass and a through hole through which the connecting portion 121 and the ink supply tube 122 can pass, which are formed through the front wall of the cover 32 at positions corresponding to the air communication opening 71 and the ink supply portion 72, respectively. Through the through holes, the rod 124 is inserted into the air communication opening 71 and the connecting portion 121 and the ink supply tube 122 are inserted into the ink supply portion 72.

Figure 10:
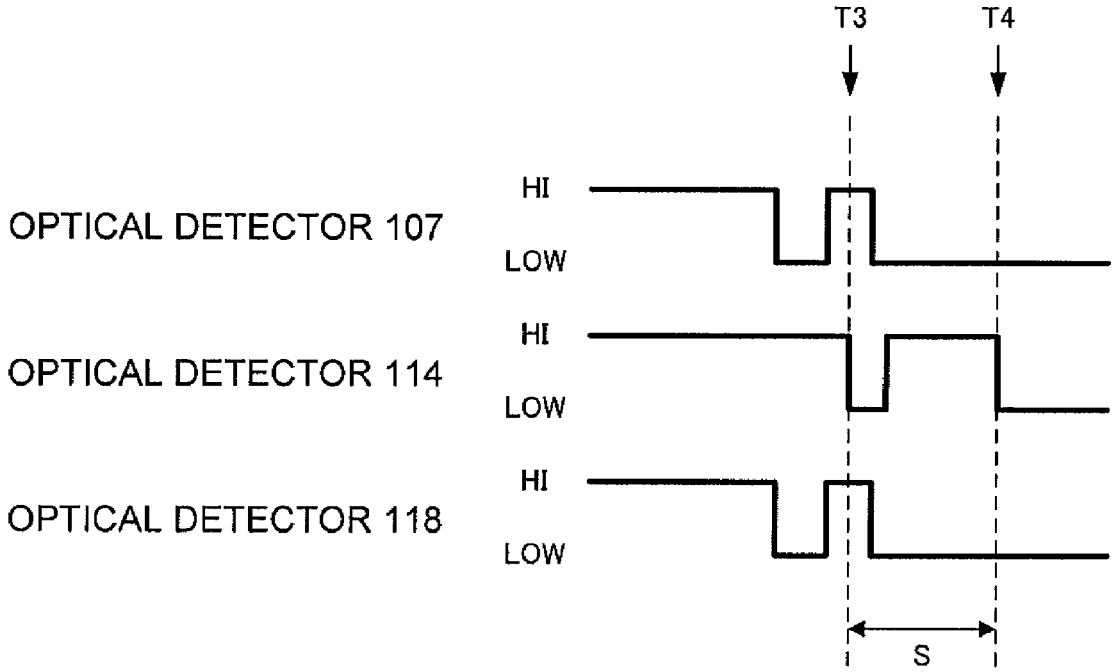
FIG. 10 is time profiles of output signals from optical detectors during an insertion of the ink cartridge of FIGS. 9A and 9B into the cartridge holder.

Similarly to the embodiment described above, when the ink cartridge 30 is mounted to the cartridge holder 110, the triggering portion 85 enters the detection area 115 of the optical detector 114 (T3 in FIG. 10) and then the irradiation portion 34C of the ink amount detection portion 34 enters the detection area 115 of the optical detector 114 (T4 in FIG. 10). During this period, the front side of the cover 32 in the insertion direction 50 contacts the end wall 117 of the cartridge holder 110.

As described above, in order for the ink amount detection portion 34 to enter the opening 33 of the cover 32, the case 31 needs to be moved in the insertion direction 50 until the case 31 is brought closest to the cover 32 after the front side of the cover 32 contacts the end wall 117 of the cartridge holder 110. According, a time period S from the timing T3 when the triggering portion 85 is started to be detected by the optical detector 114 to the timing T4 when the light blocking plate 62 in the ink amount detection portion 34 is started to be detected by the optical detector 114 becomes long (FIG. 10).

With this configuration, even when the speed of insertion of the ink cartridge 30 into the cartridge holder 110 is increased, there is a certain time difference between the first determination process and the second determination process, and the first process and the second process are reliably executed by the controller 90.

Moreover, the front portion of the case 31 is protected by the cover 32. In other words, breakage of the seal at the air communication opening 71, or breakage of the ink supply portion 72 or the ink amount detection portion 34 are prevented.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink supply device comprising:

a controller;

a cartridge mounting portion; and an ink cartridge configured to be mounted to the cartridge mounting portion by being inserted thereinto in an insertion direction, the ink cartridge comprising:

a first detection target portion positioned at an upper front side of the ink cartridge during an insertion of the ink cartridge into the cartridge mounting portion in the insertion direction;

a second detection target portion positioned at a lower front side of the ink cartridge during the insertion of the ink cartridge into the cartridge mounting portion in the insertion direction; and a third detection target portion positioned at a front side of the ink cartridge during the insertion of the ink cartridge into the cartridge mounting portion in the insertion direction, wherein the third detection target portion is positioned between the first detection target portion and the second detection target portion, wherein the cartridge mounting portion comprises:

a first detector configured to detect the first detection target portion and to output first detection information when the first detector detects the first detection target portion;

a second detector configured to detect the second detection target portion and to output second detection information when the second detector detects the second detection target portion; and a third detector configured to detect the third detection target portion and to output third detection information when the third detector detects the third detection target portion, and wherein the controller is configured to execute a first process based on whether the first detection information and the second detection information are output when the third detection information is output during the insertion of the ink cartridge into the cartridge mounting portion, and a type of the ink cartridge is determined in the first process.

2. The ink supply device according to claim 1, wherein the ink cartridge further comprises a fourth detection target portion positioned at a same height as the third detection target portion and in rear of the third detection target portion with respect to the insertion direction, the third detector is configured to detect the fourth detection target portion and to output fourth detection information when the third detector detects the fourth detection target portion, and the controller is configured to execute a second process based on whether the first detection information and the second detection information are output when the fourth detection information is output during the insertion of the ink cartridge into the cartridge mounting portion, and it is determined that the ink cartridge has reached a predetermined mount position in the second process.

3. The ink supply device according to claim 1, wherein the ink cartridge comprises a reference surface, a first protrusion protruding from the reference surface in the insertion direction, a second protrusion protruding from the reference surface in the insertion direction, and a third protrusion protruding from the reference surface in the insertion direction, and the first protrusion comprises the first detection target portion, the second protrusion comprises the second detection target portion, and the third protrusion comprises the third detection target portion.

4. The ink supply device according to claim 3, wherein each of the first protrusion and the second protrusion protrudes further than the third protrusion protrudes in the insertion direction.

5. The ink supply device according to claim 3, wherein the ink cartridge comprises an ink chamber configured to store ink therein, and the fourth detection target portion is configured to indicate an amount of ink stored in the ink chamber.

6. The ink supply device according to claim 3, wherein the ink cartridge comprises a case comprising an ink chamber configured to store ink therein, and the first protrusion and the second protrusion are configured to be removably attached to the case.

7. The ink supply device according to claim 1, wherein the ink cartridge comprises a case comprising an ink chamber configured to store ink therein, and a cover covering the front side of the ink cartridge with respect to the insertion direction, and the cover comprises the first detection target portion, the second detection target portion, and the third detection target portion.

8. The ink supply device according to claim 1, wherein the ink cartridge further comprises an ink supply portion, the ink supply portion is positioned at the front side of the ink cartridge with respect to the insertion direction, and the ink supply portion is configured to supply ink from an interior of the ink cartridge to an exterior of the ink cartridge.

9. The ink supply device according to claim 1, wherein each of the first detector, the second detector, and the third detector comprises a light receiving portion configured to receive light and a light emitting portion configured to emit light toward the light receiving portion, and the first detector, the second detector, and the third detector are configured to detect the first detection target portion, the second detection target portion, and third detection target portion, respectively, when a corresponding one of the first detection target portion, the second detection target portion, and the third detection target portion intersects an optical path between the light emitting portion and the light receiving portion, causing an intensity of light received by the light receiving portion to change.

10. The ink supply device according to claim 9, wherein each of the first detection target portion, the second detection target portion, and the third detection target portion is configured to adjust the intensity of light reaching the light-receiving portion of a corresponding one of the first detector, the second detector, and the third detector when intersecting the optical path of the corresponding one of the first detector, the second detector, and the third detector.

* * * * *